US006533248B1

(12) United States Patent
Schafer

(10) Patent No.: US 6,533,248 B1
(45) Date of Patent: Mar. 18, 2003

(54) CABLE RACK MOUNTED CABLE PULLER AND INSTALLATION SYSTEM

(76) Inventor: Richard C. Schafer, P.O. Box 694, Rowlett, TX (US) 75030

( * ) Notice: Subject to any disclaimer, the term of this patent is extended or adjusted under 35 U.S.C. 154(b) by 0 days.

(21) Appl. No.: 10/117,927

(22) Filed: Apr. 5, 2002

(51) Int. Cl.[7] ..... B66F 3/00
(52) U.S. Cl. ..... 254/134.3 FT
(58) Field of Search ..... 254/134.3 FT, 254/134.3 R, 139, 139.1, 142, 362, 292, 266, 334, 335, 339; 211/85.5, 85.8, 26, 173, 163, 164, 181.1

(56) References Cited

U.S. PATENT DOCUMENTS

| | | | | | |
|---|---|---|---|---|---|
| 2,777,667 | A | * | 1/1957 | Stafford | 254/4 R |
| 2,948,510 | A | | 8/1960 | Kieser | |
| 3,072,383 | A | | 1/1963 | Vanderhagen | |
| 4,196,864 | A | | 4/1980 | Cole | |
| 4,270,734 | A | | 6/1981 | Straight | |
| 4,497,470 | A | | 2/1985 | Carter | |
| 4,890,750 | A | * | 1/1990 | Stern | 212/153 |
| 5,366,338 | A | * | 11/1994 | Mortensen | 414/563 |
| 5,464,193 | A | | 11/1995 | Wrate | |
| 5,797,504 | A | * | 8/1998 | Mangum | 212/303 |
| 6,386,570 | B2 | * | 5/2002 | Linger | 280/441 |

* cited by examiner

*Primary Examiner*—Joseph J. Hail, III
*Assistant Examiner*—Daniel Shanley
(74) *Attorney, Agent, or Firm*—Michael S. Neustel

(57) ABSTRACT

A cable rack mounted cable puller and installation system for removably attaching to a cable rack and efficiently removing/installing cable upon the cable rack. The cable rack mounted cable puller and installation system includes a first support frame attachable to a first rail upon a cable rack, and a second support frame attachable to a second rail upon the cable rack. A shaft is rotatably supported between the upper portions of the support frames to receive a length of cable. A plurality of securing brackets are pivotally attached to a base of the support frames to selectively surround the rails. A plurality of securing fasteners within the securing brackets allow for tightening of the support frames to the rails. A coupler is attached to an end of the shaft for connecting a powered tool thereto to drive the shaft for pulling or dispensing cable. The support frames are preferably comprised of an extendable structure for accommodating cables positioned at various heights. A clutch device is preferably attached to one of the support frames for preventing a reverse rotation of the shaft during operation thereof.

15 Claims, 6 Drawing Sheets

CABLE RACK MOUNTED CABLE PULLER AND INSTALLATION SYSTEM

CROSS REFERENCE TO RELATED APPLICATIONS

Not applicable to this application

STATEMENT REGARDING FEDERALLY SPONSORED RESEARCH OR DEVELOPMENT

Not applicable to this application

BACKGROUND OF THE INVENTION

1. Field of the Invention

The present invention relates generally to cable puller/installer apparatuses and more specifically it relates to a cable rack mounted cable puller and installation system for removably attaching to a cable rack and efficiently removing/installing cable upon the cable rack.

Telecommunication locations within buildings often times utilize lengths of open cable racks to support a plurality of cables. FIG. 1 illustrates a conventional cable rack 12 which the present invention is suitable for usage upon. The cables may be comprised of various structures such as coaxial, fiber optic, DC power, twisted pair and various other types of cables. It can be difficult removing and installing elongate cables within a telecommunications environment because of the difficult location, length and physical obstruction of the cable racks. Because conventional cable puller/installer devices are not suitable for removing/installing elongate cables upon cable racks, a plurality of individuals are often times utilized and positioned at specific intervals along the cable rack to install by hand. Hence, there is a need for a cable puller/installer system that efficiently removes/installs cable from an indoor environment utilizing cable racks to support a plurality of cables.

2. Description of the Related Art

Cable puller and installer devices for removing and installing cable and other elongate material have been in use for years. Examples of patented cable puller/installer devices include U.S. Pat. No. 3,072,383 to Vanderhagen, U.S. Pat. No. 5,464,193 to Wrate, U.S. Pat. No. 4,196,864 to Cole, U.S. Pat. No. 2,948,510 to Kieser, U.S. Pat. No. 4,270,734 to Straight and U.S. Pat. No. 4,497,470 to Carter.

The main problem with conventional cable puller/installer devices is they are not designed to be securely mounted to an open cable rack and often times require more than one individual to operate. A further problem with conventional cable puller/installer devices is that they are comprised of a relatively large size making them difficult to utilize upon cable racks. A further problem with conventional cable puller/installer devices is that they require the usage of anchor holes which damage the building structure. Another problem with conventional cable puller/installer devices is that they typically require a fixed motor which increases the overall price and weight of the devices.

While these devices may be suitable for the particular purpose to which they address, they are not suitable for removably attaching to a cable rack and efficiently removing/installing cable. Conventional cable puller/installer devices are not designed for utilization within a telecommunications environment that utilizes cable racks.

In these respects, the cable rack mounted cable puller and installation system according to the present invention substantially departs from the conventional concepts and designs of the prior art, and in so doing provides an apparatus primarily developed for the purpose of removably attaching to a cable rack and efficiently removing/installing cable.

BRIEF SUMMARY OF THE INVENTION

In view of the foregoing disadvantages inherent in the known types of cable puller/installer devices, now present in the prior art, the present invention provides a new cable rack mounted cable puller and installation system construction wherein the same can be utilized, for removably attaching to a cable rack and efficiently removing/installing cable upon the cable rack.

The general purpose of the present invention, which will be described subsequently in greater detail, is to provide a new cable rack mounted cable puller and installation system that has many of the advantages of the cable puller/installer devices mentioned heretofore and many novel features that result in a new cable rack mounted cable puller and installation system which is not anticipated, rendered obvious, suggested, or even implied by any of the prior art cable puller/installer devices, either alone or in any combination thereof.

To attain this, the present invention generally comprises a first support frame attachable to a first rail upon a cable rack, and a second support frame attachable to a second rail upon the cable rack. A shaft is rotatably supported between the upper portions of the support frames to receive a length of cable. A plurality of securing brackets are pivotally attached to a base of the support frames to selectively surround the rails. A plurality of securing fasteners within the securing brackets allow for tightening of the support frames to the rails. A coupler is attached to an end of the shaft for connecting a powered tool thereto to drive the shaft for pulling or dispensing cable. The support frames are preferably comprised of an extendable structure for accommodating cable buildup on the rack at various heights. A clutch device is preferably attached to one of the support frames for preventing a reverse rotation of the shaft during operation thereof.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a cable rack mounted cable puller and installation system that will overcome the shortcomings of the prior art devices.

A second object is to provide a cable rack mounted cable puller and installation system for removably attaching to a cable rack and efficiently removing/installing cable upon the cable rack.

Another object is to provide a cable rack mounted cable puller and installation system that reduces the amount of time, labor cost and workers required to remove and install cable upon an open cable rack structure within a telecommunications office.

A further object is to provide a cable rack mounted cable puller and installation system that reduces worker fatigue and safety issues.

An additional object is to provide a cable rack mounted cable puller and installation system that is attachable to various sizes, structures and designs of cable racks.

A further object is to provide a cable rack mounted cable puller and installation system that is adjustable in height to accommodate the removal and installation of cables at various heights with respect to the cable rack.

Another object is to provide a cable rack mounted cable puller and installation system that may be powered by a conventional hand drill or similar powered tool.

A further object is to provide a cable rack mounted cable puller and installation system that does not physically damage the building structure with anchor holes.

Another object is to provide a cable rack mounted cable puller and installation system that efficiently pulls various types of cable and elongate material.

Another object is to provide a cable rack mounted cable puller and installation system that is portable and that does not damage the cable rack.

A further object is to provide a cable rack mounted cable puller and installation system that reduces the reverse movement of a cable during pulling.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
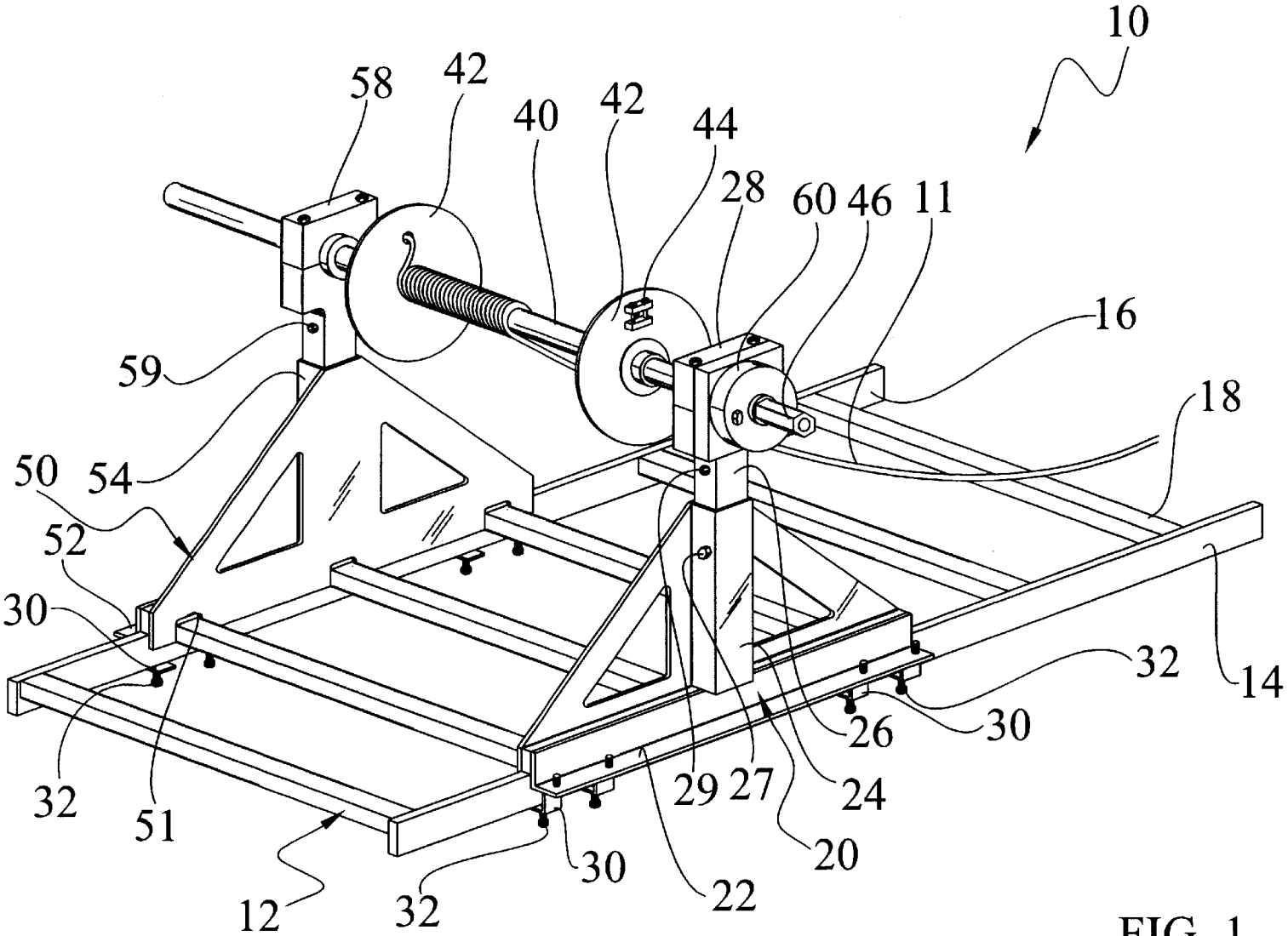
FIG. 1 is an upper perspective view of the present invention mounted to an open cable rack.

Turning now descriptively to the drawings, in which similar reference characters denote similar elements throughout the several views, FIGS. 1 through 6 illustrate a cable rack mounted cable puller and installation system 10, which comprises a first support frame 20 attachable to a first rail 14 upon a cable rack 12, and a second support frame 50 attachable to a second rail 16 upon the cable rack 12. A shaft 40 is rotatably supported between the upper portions of the support frames 20, 50 to receive a length of cable. A plurality of securing brackets 30 are pivotally attached to a base of the support frames 20, 50 to selectively surround the rails. A plurality of securing fasteners 32 within the securing brackets 30 allow for tightening of the support frames 20, 50 to the rails 14, 16. A coupler 46 is attached to an end of the shaft 40 for connecting a powered tool thereto to drive the shaft 40 for pulling or dispensing cable 11. The support frames 20, 50 are preferably comprised of an extendable structure for accommodating cables positioned at various heights. A clutch device 60 is preferably attached to one of the support frames 20, 50 for preventing a reverse rotation of the shaft 40 during operation thereof.

As shown in FIG. 1 of the drawings, an example of an exemplary cable rack 12 is illustrated having a first rail 14 and a second rail 16 substantially parallel to one another with a plurality of cross members 18 extending between the rails 14, 16. The rails 14, 16 may have various shapes, sizes and structures which are well known in the cable rack 12 industry. The distance between the rails 14, 16 may also vary significantly which is also well known in the art of cable racks 12. The present invention may be utilized upon various other types of cable racks 12 that are not illustrated within the attached figures.

As shown in FIGS. 1, 2, 3 and 5 of the drawings, the first support frame 20 has a first base 22 which is positioned adjacent to the first rail 14 of the cable rack 12. The first base 22 preferably has a length sufficient to provide adequately leverage and support to the invention during the pulling of elongate cable 11 and the like. The first base 22 includes a first channel 23 that surrounds the upper portion of the first rail 14 as best illustrated in FIG. 1 of the drawings. The first channel 23 is preferably formed for receiving various sizes of rails 14, 16 of a cable rack 12. A plurality of first cutouts (not shown) extend into the first base 22 for receiving the plurality of cross members 18. The plurality of first cutouts may have various sizes and structures desired for receiving the cross members 18.

Figure 4:
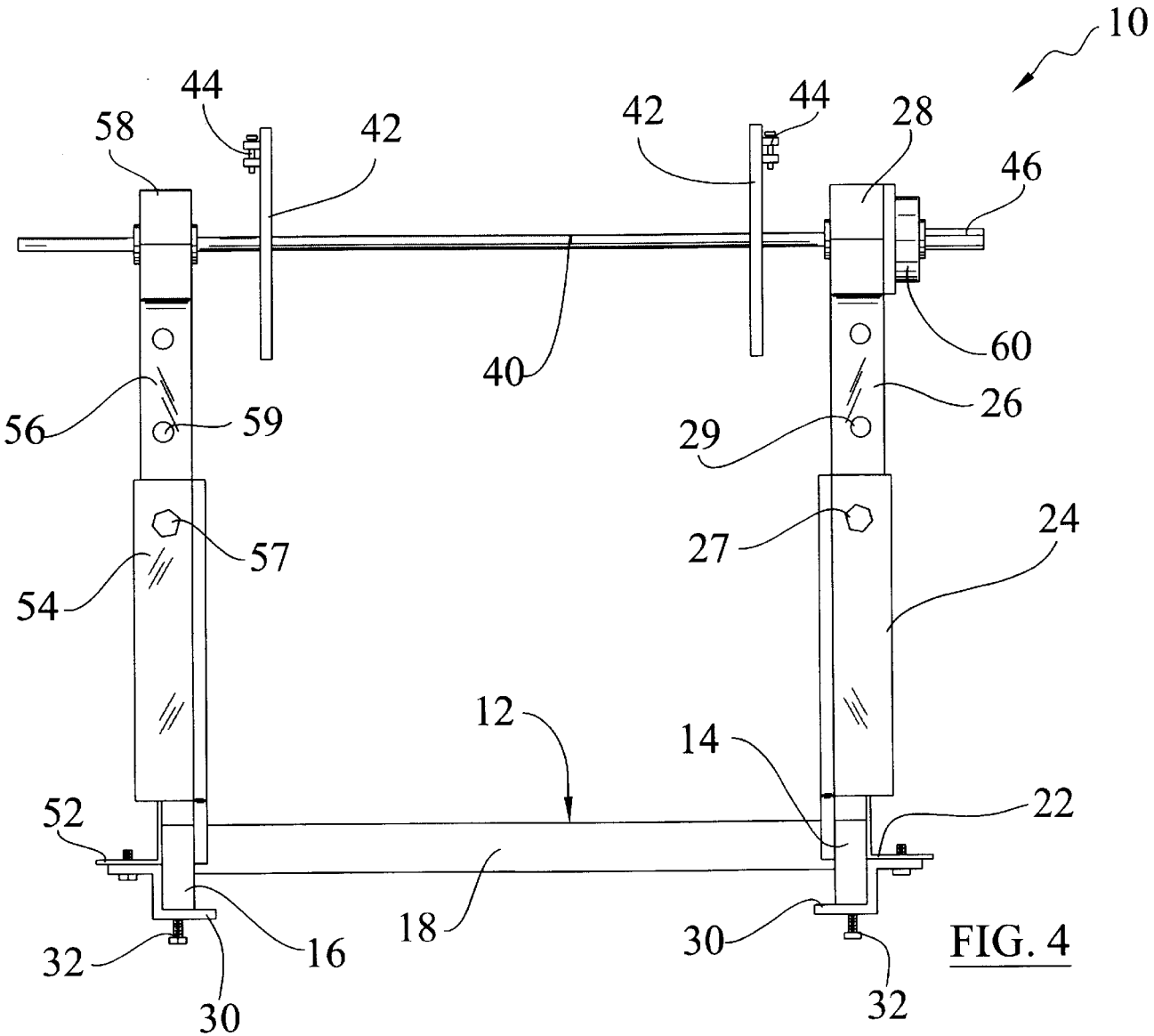
FIG. 4 is a front view of the present invention mounted to the open cable rack.
Figure 5:
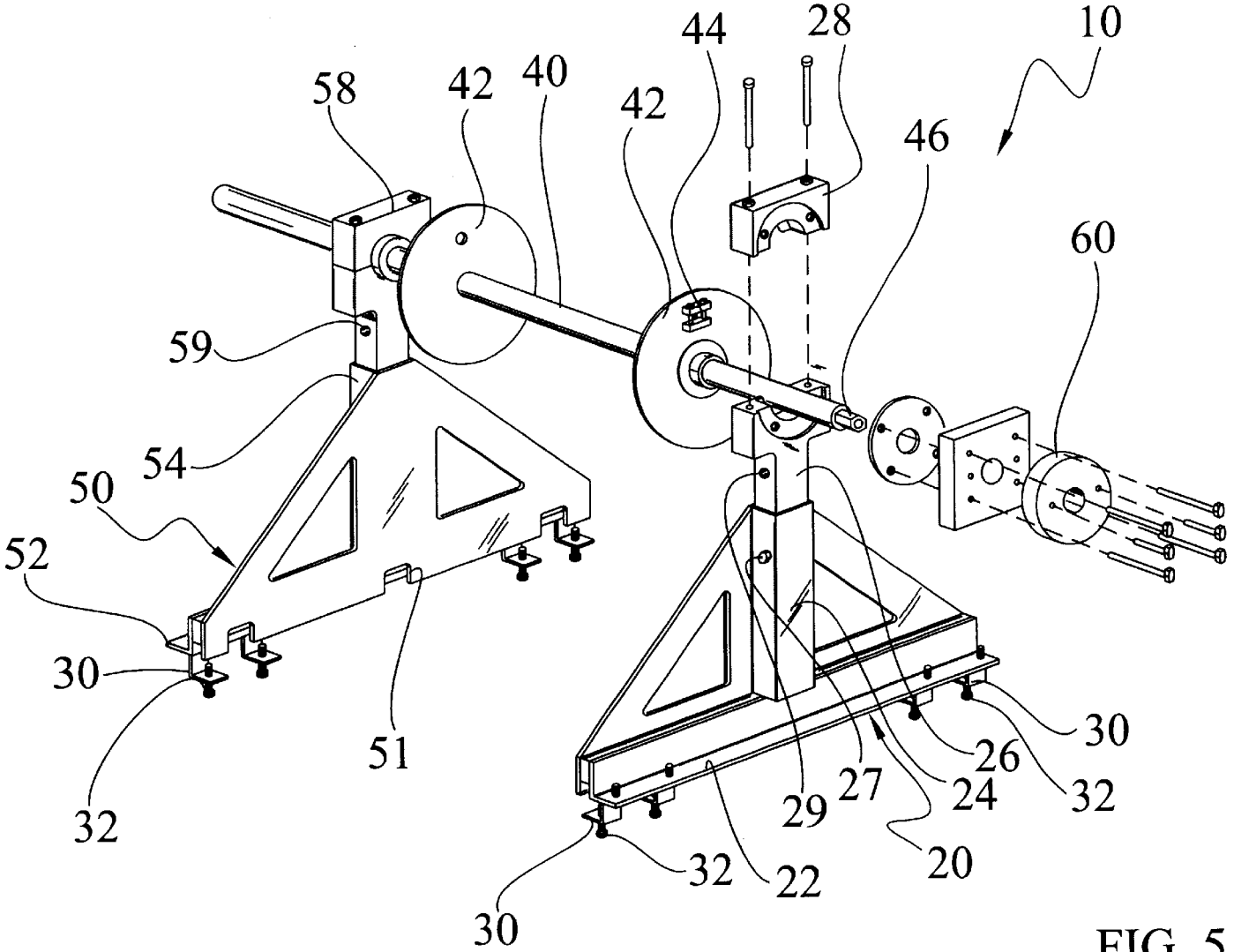
FIG. 5 is an exploded upper perspective view of the present invention.
Figure 6:
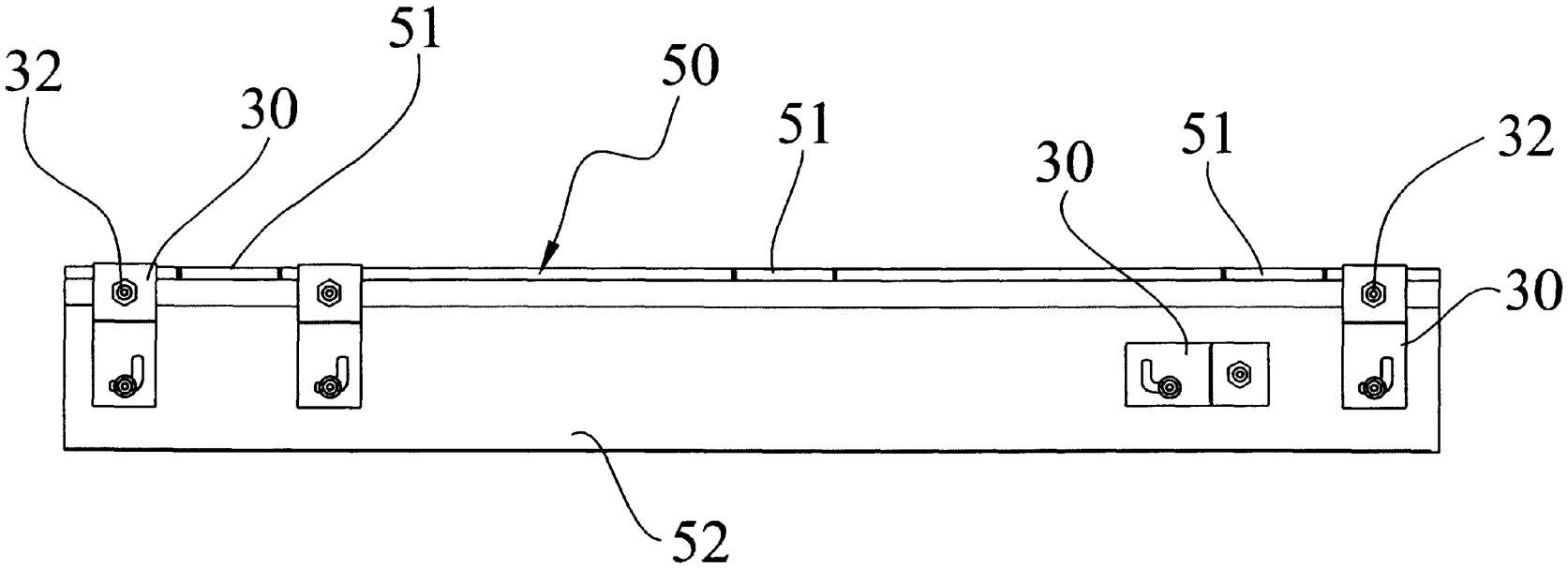
FIG. 6 is a bottom view of aside support member.

A plurality of securing brackets 30 are pivotally attached to the underside of the first base 22 as shown in FIGS. 1 through 5 of the drawings. The securing brackets 30 generally have a Z-shaped structure as best illustrated in FIG. 4 of the drawings. It can be appreciated that the securing brackets 30 may have various other shapes capable of extending beneath the underside of the rails 14, 16. A lower portion of the securing brackets 30 extends beneath the underside of the first rail 14 to allow for securing of the first support frame 20 to the cable rack 12 by a corresponding plurality of securing fasteners 32. It can be appreciated that various heights of securing brackets 30 may be utilized and interchanged to attach the first support frame 20 to various sizes of rails 14, 16. The securing fasteners 32 threadably extend within the lower portion of the securing brackets 30 and extend upwardly there through to engage the underside of the rails 14, 16 as shown in FIG. 4 of the drawings. The securing fasteners 32 may be comprised of various threaded fastener structures and may have a conventional head requiring a tool to engage or a winged structure that may be manipulated directly by a user's hand. The securing brackets 30 are each preferably pivotally attached to the first base 22 by a single conventional fastener that may be tightened and loosened as desired.

Figure 2:
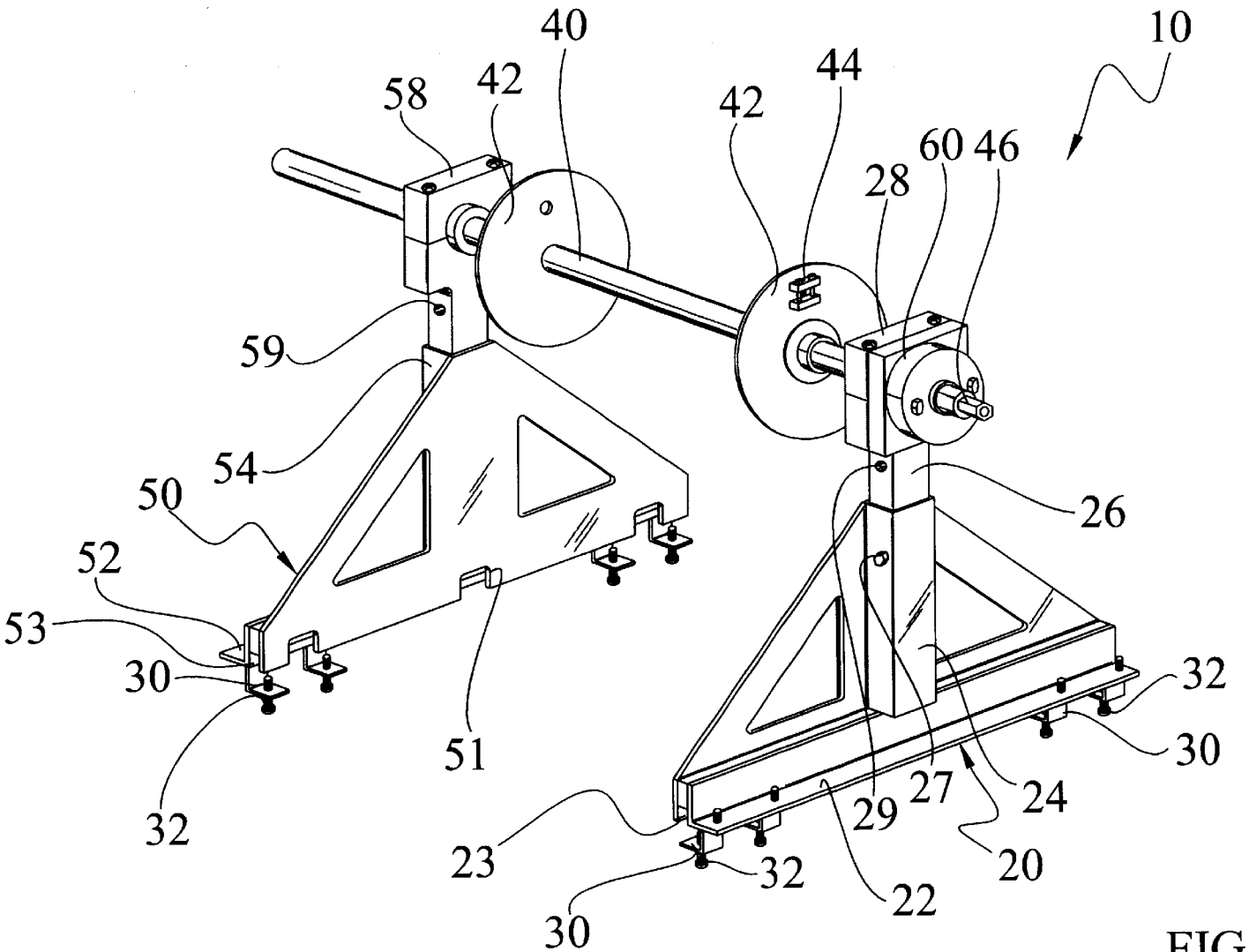
FIG. 2 is an upper perspective view of the present invention.
Figure 3:
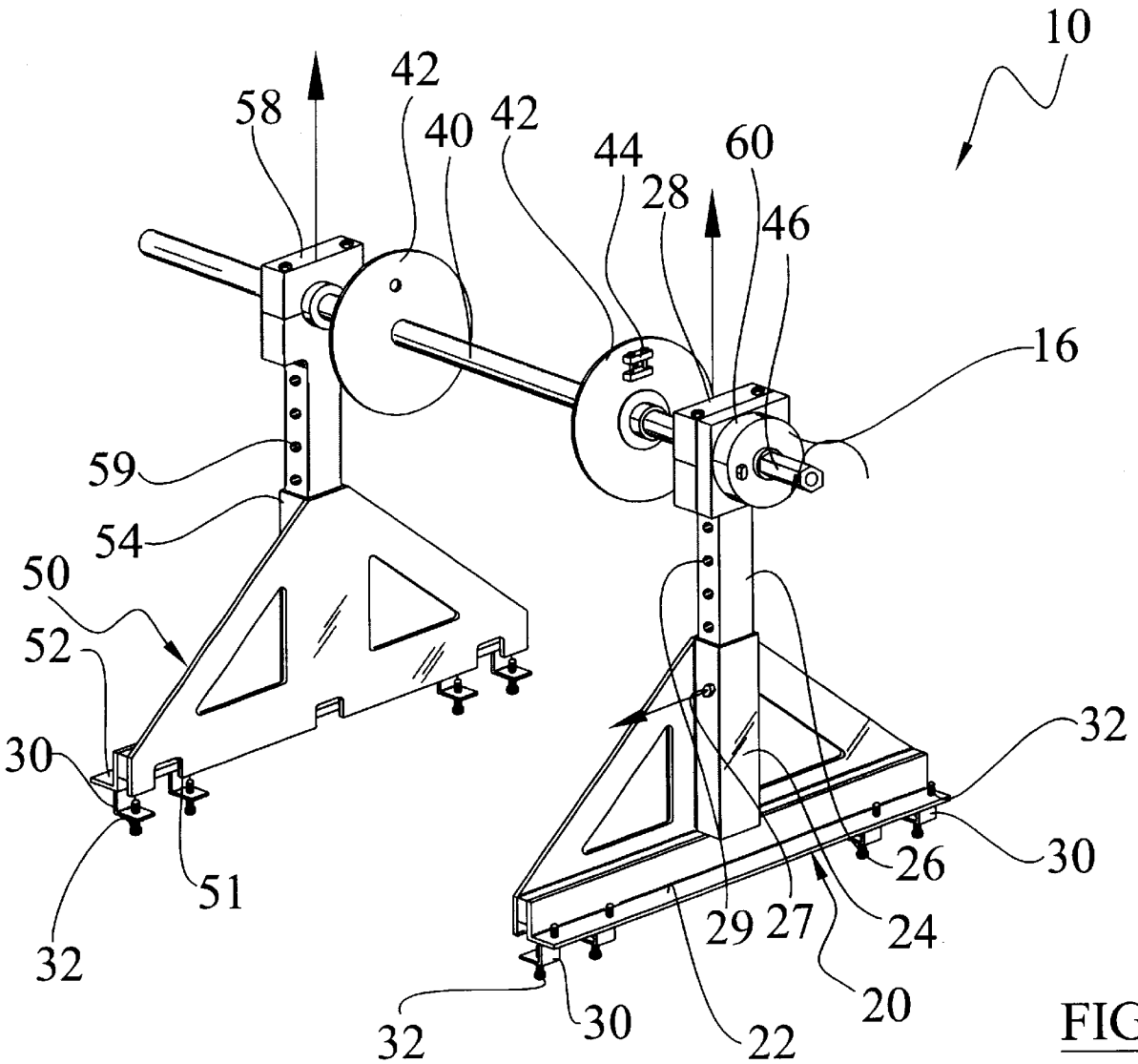
FIG. 3 is an upper perspective view of the present invention in an extended height position.

As shown in FIGS. 1 through 4 of the drawings, the first support frame 20 further includes a first member 24 having a tubular structure for slidably and adjustable receiving a first extension 26. The first member 24 extends substantially orthogonally from the first base 22 as best shown in FIG. 2 of the drawings. One or more frame members preferably extend from the first base 22 upwardly at an angle and engage the upper portion of the first member 24 for increased strength and stability. The first extension 26 has a slightly smaller outer diameter compared to the opening of the first member 24. The first member 24 includes a first locking pin 27 within that selectively extending through one of the first apertures 29 within the first extension 26. The first locking pin 27 may be retained within the selected first aperture 29 by a spring or similar biasing mechanism to prevent accidental removal of the first locking pin 27.

As shown in FIGS. 1 through 5 of the drawings, a first bearing 28 or bushing structure is attached to the upper end of the first extension 26 for rotatably receiving the shaft 40. The shaft 40 preferably is movably longitudinally within the first bearing 28 to allow for the separation of the first support frame 20 and the second support frame 50 from one another to accommodate various widths of the cable rack 12. The first bearing 28 may be comprised of any bearing structure commonly utilized. The first bearing 28 may also be directly attached to the first member 24 without utilizing the first extension 26.

As shown in FIGS. 1, 2, 3 and 5 of the drawings, the second support frame 50 is similar in design to the first support frame 20. The second support frame 50 has a second base 52 which is positioned adjacent to the second rail 16 of the cable rack 12 opposite of the first base 22 upon the first rail 14. The second base 52 preferably has a length sufficient to provide adequately leverage and support to the invention during the pulling of elongate cable 11 and the like. The second base 52 includes a second channel 53 that surrounds the upper portion of the second rail 16 as best illustrated in FIG. 1 of the drawings. The second channel 53 is preferably formed for receiving various sizes of rails 14, 16 of a cable rack 12. A plurality of second cutouts 51 extend into the second base 52 for receiving the plurality of cross members 18. The plurality of second cutouts 51 may have various sizes and structures desired for receiving the cross members 18.

A plurality of securing brackets 30 are pivotally attached to the underside of the second base 52 as shown in FIGS. 1 through 5 of the drawings. The securing brackets 30 generally have a Z-shaped structure as best illustrated in FIG. 4 of the drawings. It can be appreciated that the securing brackets 30 may have various other shapes capable of extending beneath the underside of the rails 14, 16. A lower portion of the securing brackets 30 extends beneath the underside of the second rail 16 to allow for securing of the second support frame 50 to the cable rack 12 by a corresponding plurality of securing fasteners 32. It can be appreciated that various heights of securing brackets 30 may be utilized and interchanged to attach the second support frame 50 to various sizes of rails 14, 16. The securing fasteners 32 threadably extend within the lower portion of the securing brackets 30 and extend upwardly there through to engage the underside of the rails 14, 16 as shown in FIG. 4 of the drawings. The securing fasteners 32 may be comprised of various threaded fastener structures and may have a conventional head requiring a tool to engage or a winged structure that may be manipulated directly by a user's hand. The securing brackets 30 are each preferably pivotally attached to the second base 52 by a single conventional fastener that may be tightened and loosened as desired.

As shown in FIGS. 1 through 4 of the drawings, the second support frame 50 further includes a second member 54 having a tubular structure for slidably and adjustable receiving a second extension 56. The second member 54 extends substantially orthogonally from the second base 52 as best shown in FIG. 2 of the drawings. One or more frame members preferably extend from the second base 52 upwardly at an angle and engage the upper portion of the second member 54 for increased strength and stability. The second extension 56 has a slightly smaller outer diameter compared to the opening of the second member 54. The second member 54 includes a second locking pin 57 within that selectively extending through one of the second apertures 59 within the second extension 56. The second locking pin 57 may be retained within the selected second aperture 59 by a spring or similar biasing mechanism to prevent accidental removal of the second locking pin 57.

As shown in FIGS. 1 through 5 of the drawings, a second bearing 58 or bushing structure is attached to the upper end of the second extension 56 for rotatably receiving the shaft 40. The shaft 40 preferably is movably longitudinally within the second bearing 58 to allow for the separation of the first support frame 20 and the second support frame 50 from one another to accommodate various widths of the cable rack 12. The second bearing 58 may be comprised of any bearing structure commonly utilized. The second bearing 58 may also be directly attached to the second member 54 without utilizing the second extension 56.

The shaft 40 is comprised of an elongate structure as shown in FIGS. 1 through 5 of the drawings. The shaft 40 may have a solid or tubular structure. In addition, the shaft 40 may have various cross sectional shapes other than the circular design illustrated in FIGS. 1 through 5 of the drawings. The shaft 40 is preferably sufficient in length to accommodate various possible widths of the cable rack 12. The diameter of the shaft 40 may also vary for receiving the elongate cable 11. A pair of opposing partitions 42 are preferably attached upon the middle portion of the shaft 40 for retaining the spooled elongate cable 11 between thereof during pulling of the elongate cable 11. Cable connectors within the partitions 42 are preferably utilized to connect the distal end of the elongate cable 11 within prior to pulling the elongate cable 11.

As shown in FIGS. 1 through 4 of the drawings, a coupler 46 extends from a distal end of the shaft 40 for receiving a power tool such as but not limited to a hand drill. The coupler 46 may be comprised of various shapes and sizes desirable to connect to a power tool that is capable of rotating the shaft 40 with a length of elongate cable 11 positioned upon while pulling another length of the elongate cable 11.

As shown in FIGS. 1 through 5 of the drawings, a clutch device 60 is preferably utilized to prevent the reverse rotation of the shaft 40 during usage of the present invention. The clutch device 60 allows for the free rotation of the shaft 40 in a first direction while stopping the shaft 40 if the shaft 40 begins to rotation in a second direction which is opposite of the first direction. The clutch device 60 may be turned off utilizing a lever mechanism to allow for the free rotation of the shaft 40 within the bearings 28, 58. The clutch device 60 is preferably attached to the bearings 28, 58 or to the support frames 20, 30 while be positioned coaxially upon the shaft 40 upon the coupler 46.

In use, the user positions the first support frame 20 and the second support frame 50 upon the first rail 14 and second rail 16 of the cable rack 12 with the shaft 40 positioned within in a desired location to pull cable. It can be appreciated that the support frames 20, 50 may be attached in an upward or downward manner in relation to the cable rack 12. The user then rotates the securing brackets 30 so that they are positioned beneath the respective rails 14, 16 as shown in FIG. 4 of the drawings. The user then tightens the securing fasteners 32 to reduce movement of the support frames 20, 50 with respect to the cable rack 12. The extensions 26, 56 are then adjusted to the desired height until the shaft 40 is positioned at the desired vertical height above the cable rack 12. The user then connects the desired elongate cable 11 to one of the cable connectors 44 and the connects a power tool to the coupler 46. The user then operates the power tool (or a hand tool) to drive the shaft 40 in the desired direction of rotation to retrieve the elongate cable 11. It can be appreciated that a stationary motor may be directly attached to the shaft 40 for rotating the shaft 40. The user continues rotating the shaft 40 with the power tool until finished or until a problem occurs such as the elongate cable 11 becoming snagged upon another object. If the user has problems with pulling the elongate cable 11, the user terminates the rotation of the power tool wherein the clutch device 60 prevents reverse rotation of the shaft 40. The user then may continue at anytime with pulling the elongate cable 11. When finished, the above process is reversed with the present invention placed within a compact storage location. For installing cable, the same process is utilized except with a rope or other structure attached between the rotating shaft 40 and the elongate cable 11 to be pulled.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cable rack mounted cable puller and installation system attachable to a cable rack having a first rail and a second rail, comprising:

a first support frame having a first base attachable to said first rail;

a second support frame having a second base attachable to said second rail;

a shaft rotatably supported by said first support frame and said second support frame;

a coupler extending from an end of said shaft for connecting to a hand operated tool; and a plurality of securing brackets rotatably attached to said first base and said second base, wherein said plurality of securing brackets may be rotated for selectively engaging said first rail and said second rail respectively;

wherein each of said plurality of securing brackets include a securing fastener threadably extending within thereof;

wherein said plurality of securing brackets have a Z-shaped structure.

2. The cable rack mounted cable puller and installation system of claim 1, wherein said plurality of securing brackets have a lower portion extending horizontally beneath said rails.

3. The cable rack mounted cable puller and installation system of claim 1, wherein said plurality of securing brackets are rotatably attached to said bases by a threaded fastener.

4. The cable rack mounted cable puller and installation system of claim 1, wherein said first support frame and said second support frame each include a main member having a tubular structure slidably receiving an extension member, wherein a plurality of apertures within said extension member catchably are engaged by a locking pin within said main member for securing a vertical height of said extension member.

5. The cable rack mounted cable puller and installation system of claim 4, including a bearing attached to an upper end of said extension member of said first support frame and said second support frame for rotatably receiving said shaft.

6. The cable rack mounted cable puller and installation system of claim 1, wherein said shaft includes a pair of partitions with cable connectors.

7. The cable rack mounted cable puller and installation system of claim 1, including a plurality of first cutouts within said first support frame and a plurality of second cutouts within said second support frame for receiving a corresponding plurality of cross members extending between said first rail and said second rail of said cable rack.

8. A cable rack mounted cable puller and installation system attachable to a cable rack having a first rail and a second rail, comprising:

a first support frame having a first base attachable to said first rail;

a first channel within said first base for receiving said first rail;

a second support frame having a second base attachable to said second rail;

a second channel within said second base for receiving said second rail;

a shaft rotatably supported by said first support frame and said second support frame;

a coupler extending from an end of said shaft for connecting to a hand operated tool; and a plurality of securing brackets rotatably attached to said first base and said second base, wherein said plurality of securing brackets may be rotated for selectively engaging said first rail and said second rail respectively;

wherein each of said plurality of securing brackets include a securing fastener threadably extending within thereof;

wherein said plurality of securing brackets have a Z-shaped structure.

9. The cable rack mounted cable puller and installation system of claim 8, wherein said plurality of securing brackets have a lower portion extending horizontally beneath said rails.

10. The cable rack mounted cable puller and installation system of claim 8, wherein said plurality of securing brackets are rotatably attached to said bases by a threaded fastener.

11. The cable rack mounted cable puller and installation system of claim 8, wherein said first support frame and said second support frame each include a main member having a tubular structure slidably receiving an extension member, wherein a plurality of apertures within said extension member catchably are engaged by a locking pin within said main member for securing a vertical height of said extension member.

12. The cable rack mounted cable puller and installation system of claim 11, including a bearing attached to an upper end of said extension member of said first support frame and said second support frame for rotatably receiving said shaft.

13. The cable rack mounted cable puller and installation system of claim 8, wherein said shaft includes a pair of partitions with cable connectors.

14. The cable rack mounted cable puller and installation system of claim 8, including:

a plurality of first cutouts within said first support frame; and a plurality of second cutouts within said second support frame, wherein said cutouts are for receiving a corresponding plurality of cross members extending between said first rail and said second rail of said cable rack.

15. A cable rack mounted cable puller and installation system attachable to a cable rack having a first rail and a second rail, comprising:

a first support frame having a first base attachable to said first rail;

a first channel within said first base for receiving said first rail;

a second support frame having a second base attachable to said second rail;

a second channel within said second base for receiving said second rail;

a shaft rotatably supported by said first support frame and said second support frame;

a coupler extending from an end of said shaft for connecting to a hand operated tool;

a plurality of securing brackets rotatably attached to said first base and said second base, wherein said plurality of securing brackets may be rotated for selectively engaging said first rail and said second rail respectively;

a plurality of first cutouts within said first support frame;

a plurality of second cutouts within said second support frame, wherein said cutouts are for receiving a corresponding plurality of cross members extending between said first rail and said second rail of said cable rack;

a bearing attached to an upper end of said extension member of said first support frame and said second support frame for rotatably receiving said shaft; and a pair of partitions attached to said shaft, wherein said pair of partitions include cable connectors;

wherein each of said plurality of securing brackets include a securing fastener threadably extending within thereof;

wherein said plurality of securing brackets have a Z-shaped structure;

wherein said plurality of securing brackets have a lower portion extending horizontally beneath said rails;

wherein said plurality of securing brackets are rotatably attached to said bases by a threaded fastener;

wherein said first support frame and said second support frame each include a main member having a tubular structure slidably receiving an extension member, wherein a plurality of apertures within said extension member catchably are engaged by a locking pin within said main member for securing a vertical height of said extension member.

* * * * *